United States Patent [19]

Hwang

[11] Patent Number: 4,931,913

[45] Date of Patent: Jun. 5, 1990

[54] PORTABLE SIRENING AND ILLUMINATION DEVICE

[76] Inventor: Feng-Lin Hwang, No. 21, Pa Te Rd., Chi Tu District, Keelung City, Taiwan

[21] Appl. No.: 357,931

[22] Filed: May 26, 1989

[51] Int. Cl.[5] ..... F21L 15/22

[52] U.S. Cl. ..... 362/103; 362/198:253; 362/258

[58] Field of Search ..... 362/103, 198, 200, 208, 362/253, 258, 403

[56] References Cited

U.S. PATENT DOCUMENTS

| | | | |
|---|---|---|---|
| 726,773 | 4/1903 | Shute | 362/403 |
| 1,282,555 | 10/1918 | Ericksen | 362/200 |
| 1,319,473 | 10/1919 | Grigsby | 362/258 |
| 1,523,498 | 1/1925 | Stark | 362/258 |
| 1,769,241 | 7/1930 | Stephani | 362/103. |
| 1,959,979 | 5/1934 | Gunderson | 362/198 |
| 3,112,889 | 12/1963 | Marmo et al. | 362/103 |
| 4,432,041 | 2/1984 | Pfisterer | 362/200 |
| 4,835,665 | 5/1989 | Kao | 362/208 |

*Primary Examiner*—Stephen F. Husar
*Assistant Examiner*—Richard R. Cole
*Attorney, Agent, or Firm*—Browdy and Neimark

[57] ABSTRACT

A portable sirening and illumination device comprising a casing which has a fastening belt for hbuckling onto wrist or ankle part of a user, an illumination assembly having a power lead drawable outward to approach object for a close view, a power lead return assembly for recoiling back the outward-drawn power lead, and a PC board producing sirening sounds and flashes form a light bulb. The device is conveniently used both for illumination at ordinary time and for distress call at emergency via its produced sirening sounds and flashes.

1 Claim, 3 Drawing Sheets

PORTABLE SIRENING AND ILLUMINATION DEVICE

FIELD OF THE INVENTION

The present invention relates to a portable sirening and illumination device which is used for illumination at ordinary time and, in particluar, used for distress call via its produced sirening and flashes during emergencies such as an attack, a kidnapping, or an accident.

BACKGROUND OF THE INVENTION

Child kidnappings are on the increase according to recent newspaper reports. Parents, therefore, become extremely concerned about their children's safety and teach their children never to speak to any strangers on the street when going out alone or in schoolmate's accompany. Nonetheless, child kidnapping still takes place. The major reason is that the kid's self-defence ability is so weak that he or she has difficulty in making distress call. The same situation happens to women. As more and more women go out working in present society, their safety after office or job in the night becomes a matter of concern. Because of their insufficiency in distress call like the children, women are easily targeted by criminals. For these reasons children and women need to have a means to signal their distress at times of emergency.

OBJECT OF THE INVENTION

The present invention is directed to solving the above problem by providing a portable sirening and illumination device which has features:

1. The light bulb, which flashes a signal in an emergency, and can be used for common illumination at ordinary time.
2. A power lead connected to an illumination light bulb, can be drawn outward to permit close viewing of an object a push switch draws back the outward-drawn power lead to its original state when the light is turned off.
3. When there is a distress call, the sirening sounds and flashes will be delivered simultaneously.

SUMMARY OF THE INVENTION

The portable sirening and illumination device comprises a casing containing all related assemblies which is provided with a fastening belt to buckle onto the wrist or ankle part of the user, an illumination assembly to which an outward drawable power lead is connected an automatic return assembly to recoil back the outward-drawn power lead, a PC (printed circuit) board for causing sirening sounds and flashes from a light bulb, and source of battery power. The device is portable with its fastening belt used for illumination in darkness, and is used for distress calls by means of sirening sounds and flashes during an emergency such as an attack, a kidnapping, or an accident.

SPECIFIC DESCRIPTION

Figure 1:
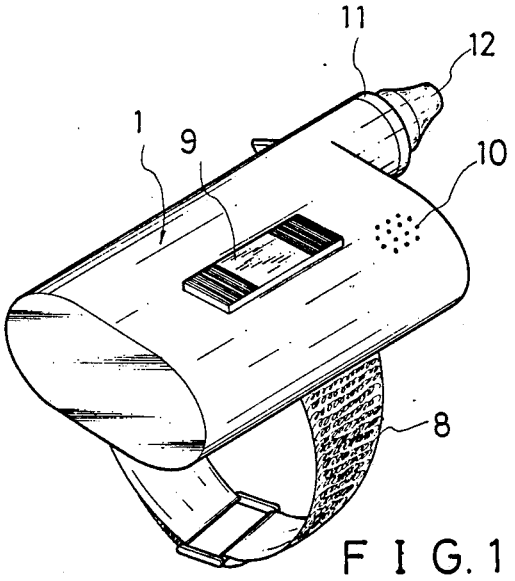
FIG. 1 is an appearance perspective view of the invention.
Figure 2:
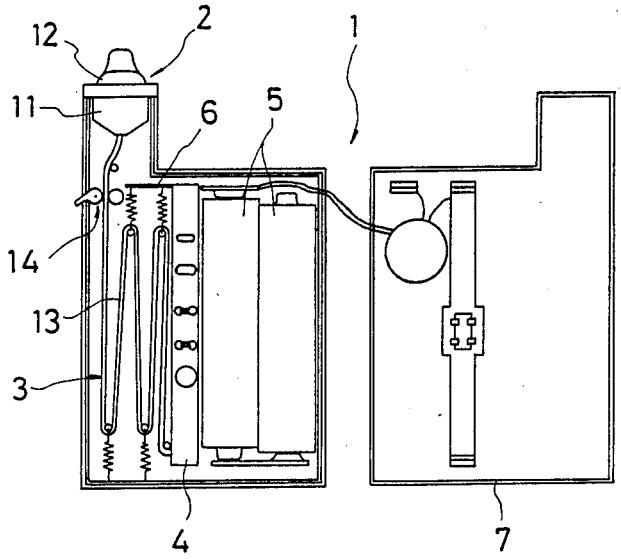
FIG. 2 is an internal construction view of the invention after the cover body is opened.
Figure 3:
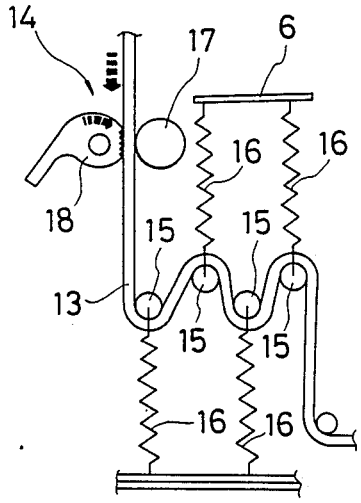
FIG. 3 is an enlarged view of automatic return assembly for returning the power lead of the invention.

Firstly referring to FIGS. 1 and 2, the invention comprises a casing 1 which contains all the related assemblies and has a fastening belt for buckling onto the wrist or ankle part of a user, an illumination assembly 2 has a power lead which is drawable outward and is connected to an automatic return assembly 3 responsive for returning the power lead in an indrawn position. A PC board 4 causes sirening sounds and flashes from a light bulb A pair of source batterys 5 supplies power. Casing 1 is in rectangular or other proper form and is made up by main body 6, cover body 7, and fastening belt 8. Main body 6 accomodates all the above said assemblies (as shown in FIG. 2). A body 6, which has a three-stage switch 9 and a plurity of sound bores 10 provided, is illustrated in FIG. 1. Illumination assembly 2 consists of a light bulb seat 11 extending casing 1, a small light bulb 12 fitted thereon, and a power lead 13 which connects to the bottom part of light bulb seat 11. When necessary, light bulb seat 11 can be held in user's hand drawing out power lead 13 and, by wrapping the power lead round finger, light bulb 12 can approach any object for at close view. A end of use, a push to position clamp 14 will cause power lead 13 to automatically return back into casing 1. Automatic return assembly 3 comprises pullies 15, spiral springs 16, and position clamp 14. Power lead 13 has a flexible sleeve provided, and the back end of the lead 13 combines with PC board 4 and three-stage switch 9 power lead 13 is wound amid pullies 15. The spiral springs 16 are positioned at two ends opposing each other inside casing 1 and hold power lead 13 tight in position therebetween. Position clamp 14 consists of a fixed piece 17 and an eccenter 18 (as shown in FIG. 3). The clamp 14 will hold power lead 13 when drawn out. The clamp 14 will automatically clamp at disappearance of the outside drawing force, by virtue of the drawing-back force from spiral springs 16 and friction force of eccenter 18 against fixed piece 17. When outside drawing force is applied to power lead 13 the friction force appearing at position clamp 14 will move eccenter 18 to allow outward movement. The drawing-back force from spiral springs 16 draws back power lead 13 into casing 1 when a downward push of clamp lever **14*a* is made. Lever 14*a* releases the lead 13**.

Figure 4:
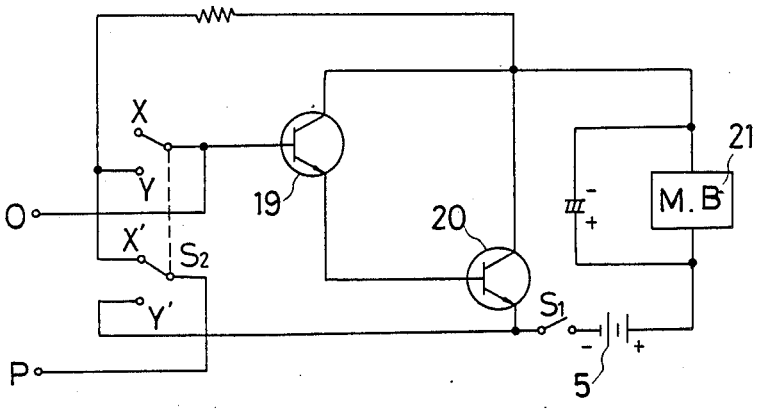
FIG. 4 is a diagram view of production of sirening sounds.

PC board 4 is provided of the required circuits to generate sirening sounds and flashes from the light bulb. The siren sound-generating circuit is shown in FIG. 4. Sound is created by transistors 19 and 20 which form a Darlington circuit which has a very high current amplification ratio. Since there is small amount of current entering the base electrode of transistor 19 (bias current), the collector current of transistor 20 will have thousands of times of gain, making buzzer 21 which is connected to the collector electrode of transistor 20 send sound.

Figure 5:
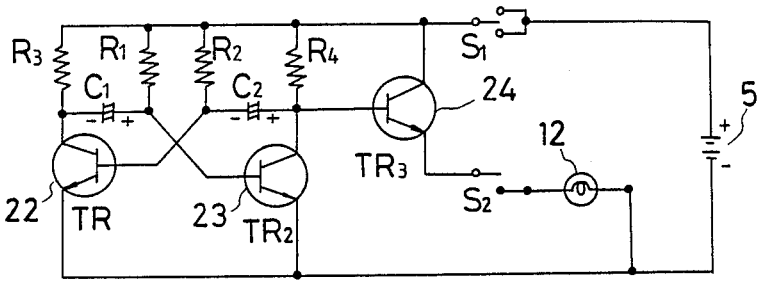
FIG. 5 is a diagram view of cause of flashes from the light bulb of the invention.

Now referring to FIG. 5, the flash generating circuit is created by transistors 22 and 23 which establish a multivibrator. While working, transistors 22 and 23 alternately make conduction and cut-off and transistor 24, the base electrode of which has connection to the collector electrode of transistor 23, picks up the intermittent conduction thereof, and by means of the intermittent conduction transistor 24 turns on and off. The small light bulb connected to the emitter of the circuit emitting flashes in response to conduction of transistor 24.

Figure 6:
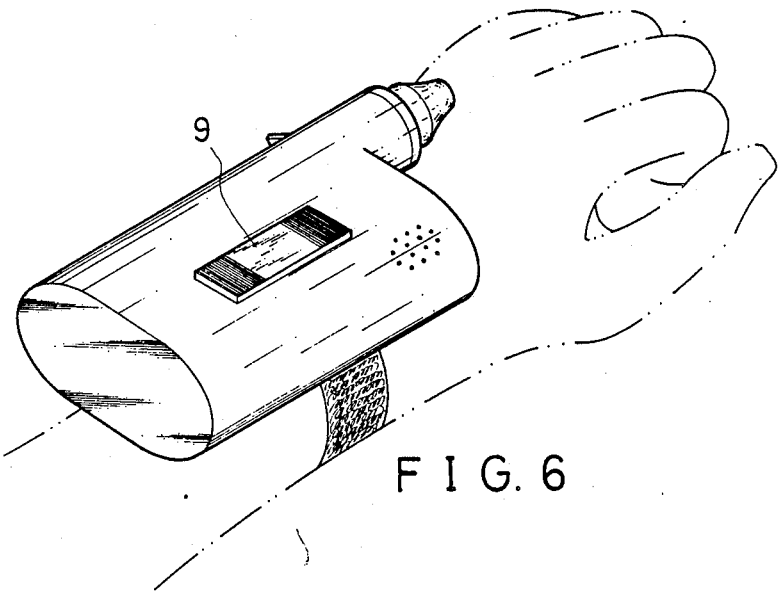
FIG. 6 is a ready-to-use state view of invention.

As FIG. 6 illustrates, with fastening belt 8 provided, the device may be buckled onto the wrist or other proper part of a user for convenient use. To turn on the light, only a push to three-stage switch 9 to its designated illumination position is required. Likewise, to transmit distress call, only a push to three-stage switch 9 to its designated distress position will cause a series of sirening sounds and light flashes. The source battery 5 of this invention can be a solar battery to be charged with solar power.

I claim:

1. A portable siren and illumination device comprising in combination:

a casing having a fastening belt for buckling onto wrist or other part of a user; a main body, and a cover body;

an illumination assembly having a power lead which is able to be drawn outward;

an automatic power lead return assembly that includes a plurality of pullies, a plurality of springs, and a position clamp, said power lead having a flexible sleeve and a back end thereof connected to a circuit and having a portion winding amid said pullies;

said pullies, being connected to said plurality of springs, said pullies and springs being positioned and arranged in two opposite sides of said casing, and said power lead by means of a drawing force exerted on said strips being and held tight amid said pullies;

said power lead moving past a position clamp;

said position clamp having a fixed piece and an eccenter, which can clamp or release;

said power lead returning into said casing by means of a drawing force from said spiral springs and being held in and extended position by the friction force between said power lead and said position clamp; and a PC board for producing siren sounds and for producing flashes from said illumination assembly; and wherein said device is able to be used for illumination and for distress call at emergency.

* * * * *